US005177832A

United States Patent [19]

McCoy

[11] Patent Number: 5,177,832

[45] Date of Patent: Jan. 12, 1993

[54] APPARATUS FOR SUCTION CLEANING TRAVELING TEXTILE YARNS

[76] Inventor: Daniel W. McCoy, P.O. Box 967, Monroe, N.C. 28110

[21] Appl. No.: 685,623

[22] Filed: Apr. 15, 1991

[51] Int. Cl.[5] ..... A47L 5/38

[52] U.S. Cl. ..... 15/308; 15/309.1; 28/173

[58] Field of Search ..... 15/306.1, 309.1, 308; 139/1 C; 28/173, 222

[56] References Cited

U.S. PATENT DOCUMENTS

| | | | |
|---|---|---|---|
| 1,703,852 | 2/1929 | Davis . | |
| 1,850,502 | 2/1932 | Hilker . | |
| 3,751,756 | 8/1973 | Arnett | 15/309.1 |
| 4,103,390 | 8/1978 | Tucker | 28/173 |
| 4,159,579 | 7/1979 | Hoddinott et al. | 15/309.1 X |
| 4,894,893 | 2/1990 | Okuda . | |

*Primary Examiner*—Chris K. Moore
*Attorney, Agent, or Firm*—Shefte, Pinckney & Sawyer

[57] ABSTRACT

Apparatus for cleaning surface lint and debris from a plurality of traveling textile warp yarns includes a slotted reed mounted on a vacuum housing with each reed slot opening into the housing interior. A blower is disposed within the housing to apply suction to the yarns traveling through the reed slots and a filter is interposed between the reed and the blower to separate lint and debris removed from the yarn. A cover is movable into and out of covering relation to the reed to constrain ambient air to be drawn into the housing from the opposite sides of the reed generally in alignment with the direction of yarn travel to prevent the suction force from imposing additional tension on the yarns and to minimize entrance of air borne ambient lint into the vacuum housing.

22 Claims, 7 Drawing Sheets

FIG. 6

APPARATUS FOR SUCTION CLEANING TRAVELING TEXTILE YARNS

BACKGROUND OF THE INVENTION

The present invention relates generally to textile yarn handling systems and, more particularly, to suction cleaning of one or more traveling textile yarns to remove lint and other debris therefrom, especially, for example, a plurality of side-by-side warp yarns.

It is well known within the textile industry that, in the production of textile fabrics, whether by weaving, knitting, or other fabric forming process, the quality of the yarn or yarns from which the fabric is formed has a direct affect on the quality of the resultant fabric. For example, air borne fibrous lint, dust, and other debris which are inherently released in textile manufacturing operations may tend to collect on textile yarn and, in turn, if not removed, may produce a defect in fabric produced from the yarn. By way of example and without limitation, the quality of woven fabric produced on high speed air jet weaving looms is known to be particularly sensitive to the presence of accumulated lint on the yarns employed in the weaving operation. Typically, in preliminary yarn preparation, a sizing may be applied to such yarns by passage of the yarns through a sizing bath, wherein fibrous lint and debris can detach from the yarns, collect or accumulate with other lint and debris in the bath, and then reattach to the yarn in larger globules which dry on the yarn producing a defective yarn slub.

SUMMARY OF THE INVENTION

It is accordingly an object of the present invention to provide an apparatus for removing accumulated lint and other debris from a textile yarn or yarns during ordinary traveling movement of the yarn as part of a normal yarn handling operation, so that no special additional lint-removal steps or processing is necessary.

In its most fundamental aspect, the present invention provides an apparatus for cleaning a traveling textile yarn having a yarn guide arrangement which defines entrance and exit openings and a substantially enclosed yarn guide passageway extending between the openings for yarn travel through the passageway. A suction arrangement is provided for applying a suction force to the passageway transversely with respect to the path of yarn travel to remove lint and other debris from the traveling yarn.

Preferably, the suction arrangement is effective to drawn ambient air into the passageway through each of the entrance and exit openings with generally equal suction force to minimize imposition of additional tension on the traveling yarn. As preferably constructed, the yarn guide arrangement has a base which defines the passageway, the entrance and exit openings, and a longitudinal slot opening transversely into the passageway along its length, with a movable cover or other suitable means for selectively opening and closing the slot to enclose the passageway.

Lint and debris removed by the suction arrangement is preferably collected by a filter or other suitable device. For example, the filter may be in the form of a elongate filter substrate which is longitudinally movable for collecting lint and debris thereon in the form of an elongate blanket of indeterminate length so that effective use may be made of the collected lint. It is also preferred that a suitable mechanism or arrangement be provided for reciprocating or otherwise moving the traveling yarn within the passageway transversely of the direction of yarn travel for wiping contact with the interior surface of the yarn guide arrangement to inhibit collection of lint and debris thereon.

In a preferred embodiment of the yarn cleaning apparatus, a reed for guiding a plurality of traveling textile yarns in segregated side-by-side relation, e.g., in a textile warp handling system, may be configured with a plurality of substantially enclosed yarn guide passageways arranged in generally side-by-side relation, each passageway having entrance and exit openings for travel of a respective yarn through each passageway. A suction arrangement applies a suction force to each passageway transversely with respect to the path of yarn travel to remove lint and other debris from each yarn.

DESCRIPTION OF THE PREFERRED EMBODIMENT

Figure 1:
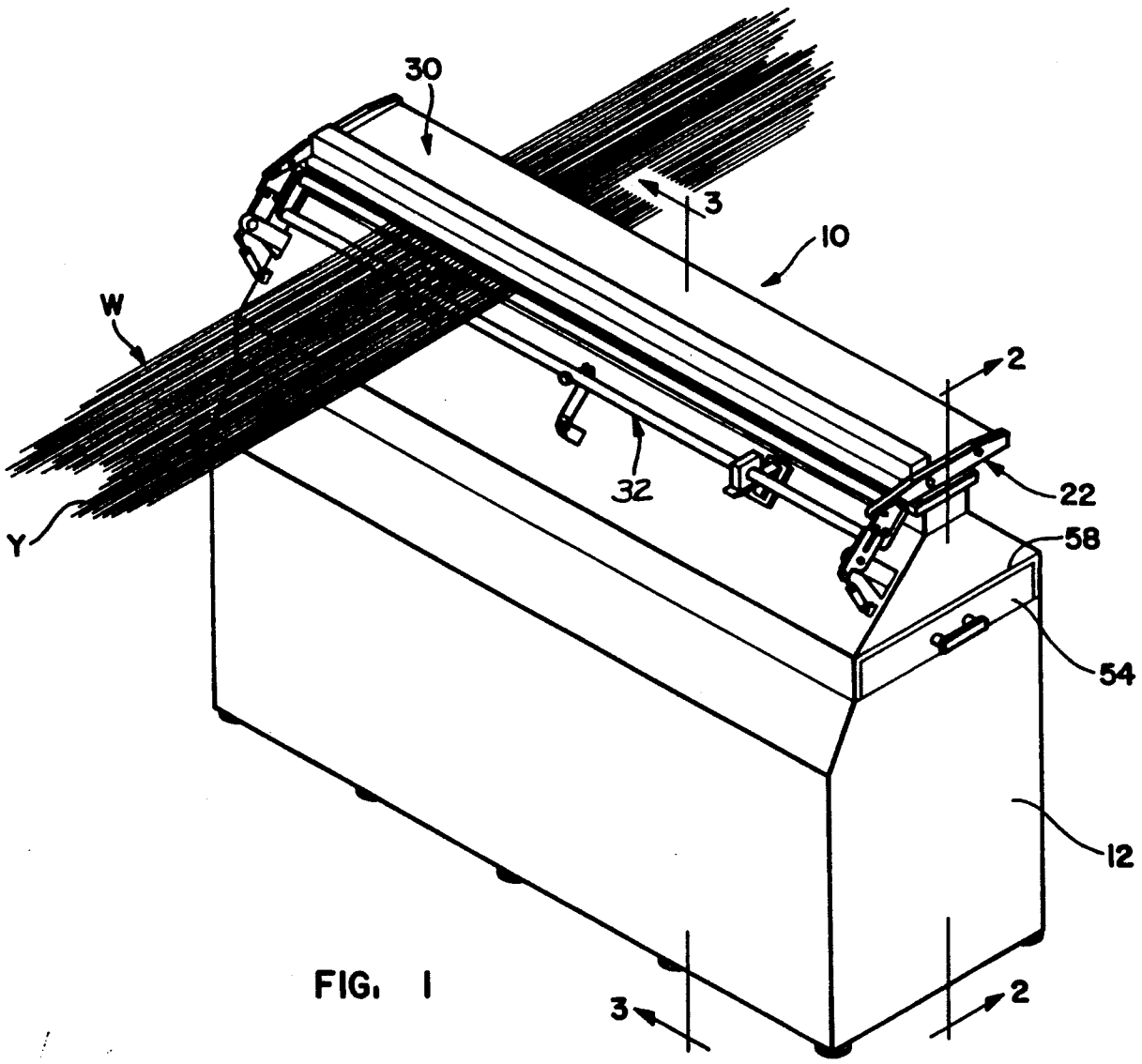
FIG. 1 is a rear perspective view of the textile yarn cleaning apparatus of the present invention according to a preferred embodiment thereof in a reed for use in a textile warping system.
Figure 2:
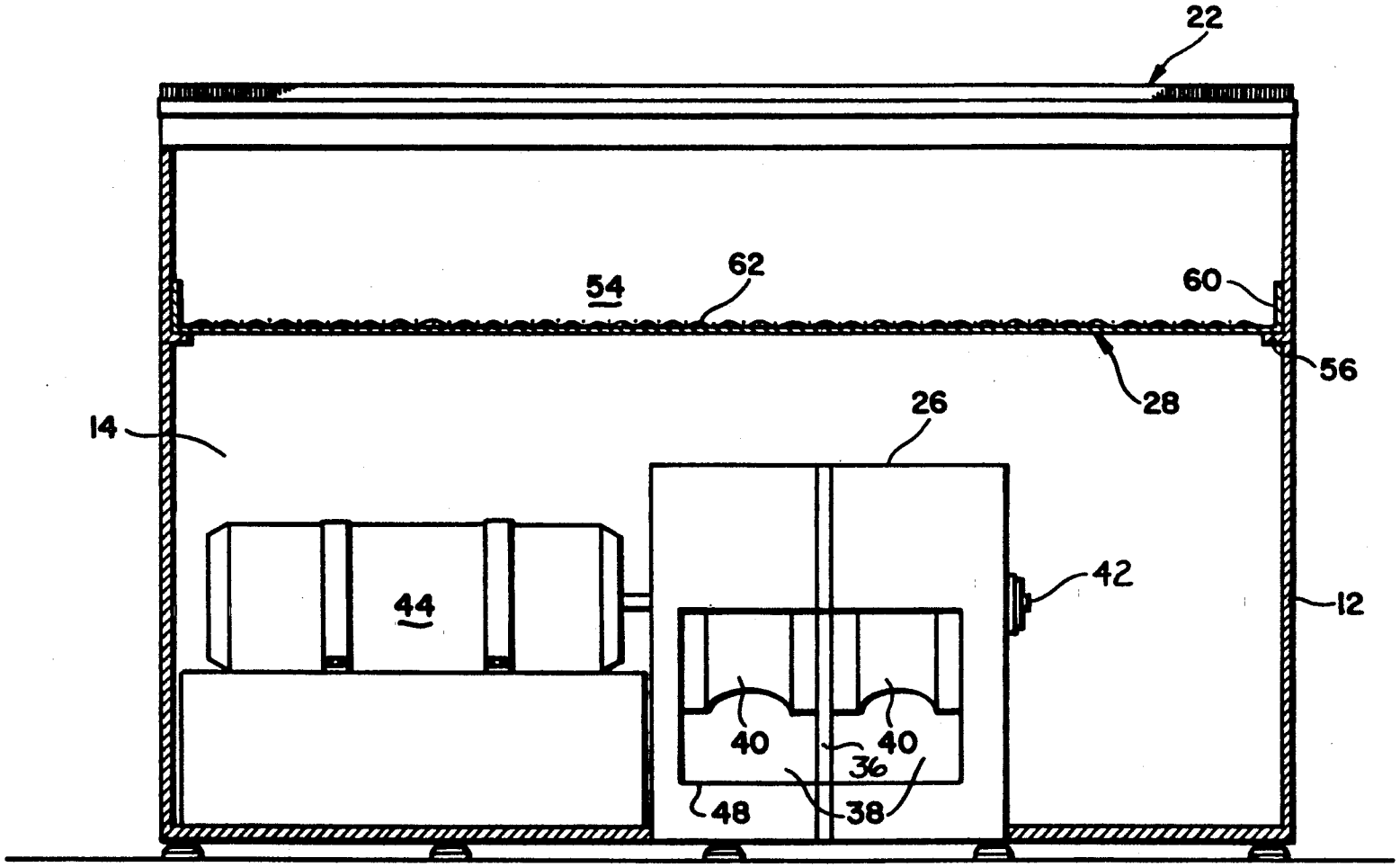
FIG. 2 is a vertical cross-sectional view of the yarn cleaning apparatus of FIG. 1, taken along line 2—2 thereof.
Figure 3:
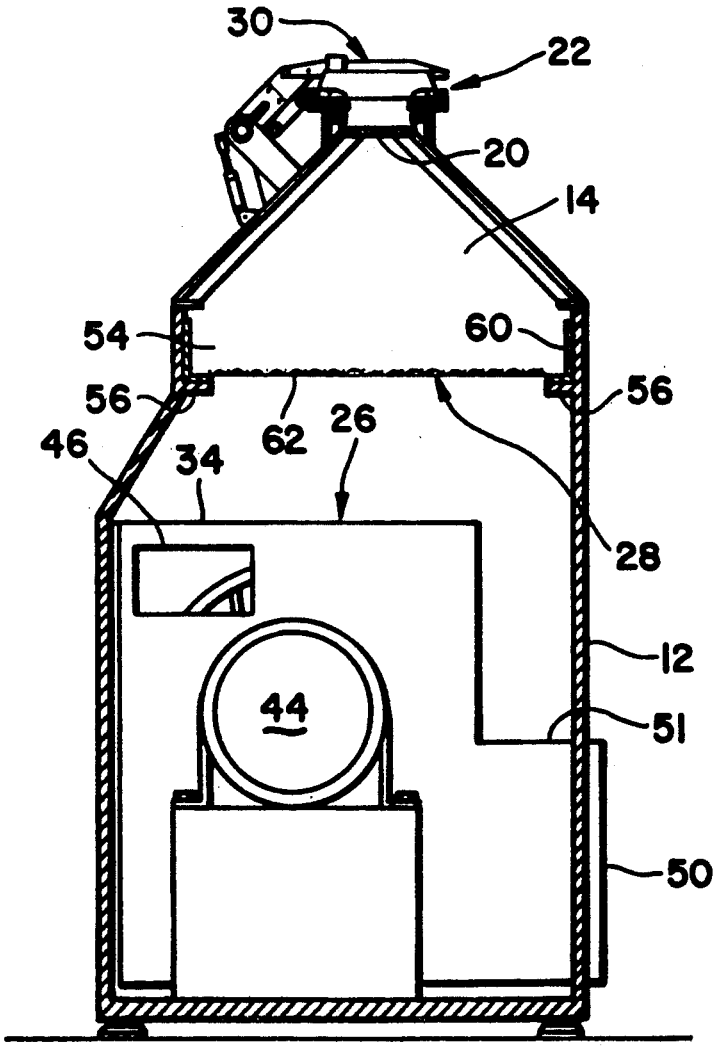
FIG. 3 is another vertical cross-sectional view of the yarn cleaning apparatus of FIG. 1, taken along line 3—3 thereof.

Referring now to the accompanying drawings and initially to FIGS. 1-3, the present apparatus for cleaning traveling textile yarns is shown generally at 10 as preferably embodied in a reed for use in a textile warping system for segregated guiding of a plurality of textile yarns Y traveling in side-by-side relation in the form of a warp sheet W, only a representative part of which is shown. However, it will be understood by those persons skilled in the art that the present yarn cleaning apparatus is equally susceptible of various other embodiments for cleaning one or more traveling textile yarns as part of other textile yarn handling systems and, accordingly, it is to be understood that the yarn cleaning apparatus of the present invention is not limited in application to textile warping reeds.

As seen in FIGS. 1 and 2, the yarn cleaning apparatus 10 includes an upstanding floor supported housing 12 having a substantially enclosed open interior area 14. The housing 12 is upwardly tapered widthwise to a narrow, upwardly-facing longitudinal slot-like opening 20 (FIG. 3) at the upper end of the housing 12. A reed assembly, generally indicated at 22, is mounted on the upper end of the housing 12 in covering relation to the longitudinal opening 20. As more fully described hereinafter, the reed 22 defines a plurality of yarn guide slots 24 (FIG. 5) in side-by-side parallel relation along the length of the reed assembly 22 with each slot 24 opening downwardly through the longitudinal opening 20 in communication with the interior area 14 of the housing 12.

A motor-driven blower 26 is contained within the enlarged lowermost section of the housing 12, with the intake side of the blower 26 opening to the interior area 14 of the housing 12 and the output side of the blower 26 vented to the exterior of the housing 12 to produce a vacuum within the housing interior 14 to apply a suction force to draw ambient air downwardly into the housing interior 14 through the slots 24 in the reed assembly 22. A filter assembly 28 is horizontally disposed within an intermediate section of the housing 12 between the blower 26 and the reed assembly 22 to filter airborne debris from the ambient air drawn by the blower 26 into the housing 12.

A cover assembly 30 is mounted to the exterior of the housing 12 at its upper end for selective movement into an and out of covering relation with the reed assembly 22. A yarn manipulating mechanism 32 is also mounted to the exterior of the housing 12 at its upper end to the reciprocably move the warp sheet W of yarns Y upwardly and downwardly within the respective reed slots 24 periodically over the course of a warping operation, as more fully described hereinafter.

Various conventional motor-operated blowers will be suitable for use as the blower 26. As best seen in FIGS. 2 and 3, in the preferred embodiment of the apparatus 10, the blower 26 has a fan housing 34 having an interior dividing wall 36 defining two substantially identical side-by-side fan chambers 28 each containing a respective rotary fan wheel or impeller 40 coaxially mounted on a common shaft 42 rotatably journaled at opposite sides of the housing 34. A single electric motor 44 is affixed to one end of the shaft 42 for synchronously driving both impellers 40. A pair of air intake openings 46 are formed respectively at corresponding locations in the opposite end walls of the housing 34 to open, respectively, into the fan chambers 38 thereby to communicate each chamber 38 independently with the interior area 14 of the housing 12. Similarly, an exhaust opening 48 is formed at one side of the housing 34 spanning and opening into both chambers 38 for forced air output from the blower 26, the housing 34 being disposed with the exhaust opening 48 facing and being communicated through ductwork 51 with a corresponding exhaust opening 50 formed in the housing 12. Additional ductwork (not shown) may be connected to the exhaust opening 50 exteriorly of the housing 12 to deliver the air output of the blower 26 to any desired discharge location remote from the apparatus 10.

The filter assembly 28 may also be of substantially any construction suitable for separating lint, dust, and like debris of the types typically found on traveling textile yarns and in the ambient air of textile mills. In the preferred embodiment illustrated in FIGS. 1-3, the filter assembly 28 is in the form of a rectangular drawer 54 supported horizontally within the interior area 14 in the intermediate section of the housing 12 on slide members 56 projecting laterally inwardly from the frame work 16 for selective sliding movement of the drawer 54 inwardly and outwardly with respect to the housing 12 through an opening 58 formed in the housing 12 at one end thereof. The drawer 54 has a rectangular outer frame 60 correspondingly dimensionally to the rectangular interior of the housing 12 in its intermediate section, the drawer frame 60 further having suitable seal strips or other sealing members (not shown) along its outer periphery to form a substantially air impervious seal between the drawer frame 60 and the interior of the housing 12 when the drawer 54 is in its inward disposition within the housing 12. A filter fabric or other filter media 62, suitable for separating fibrous textile lint and other dust and debris from moving air, is supported by the drawer frame 60 transversely across the entire area defined by the frame 60, to form a filtering barrier to all air drawn by the blower 26 into and through the housing 12.

Figure 4:
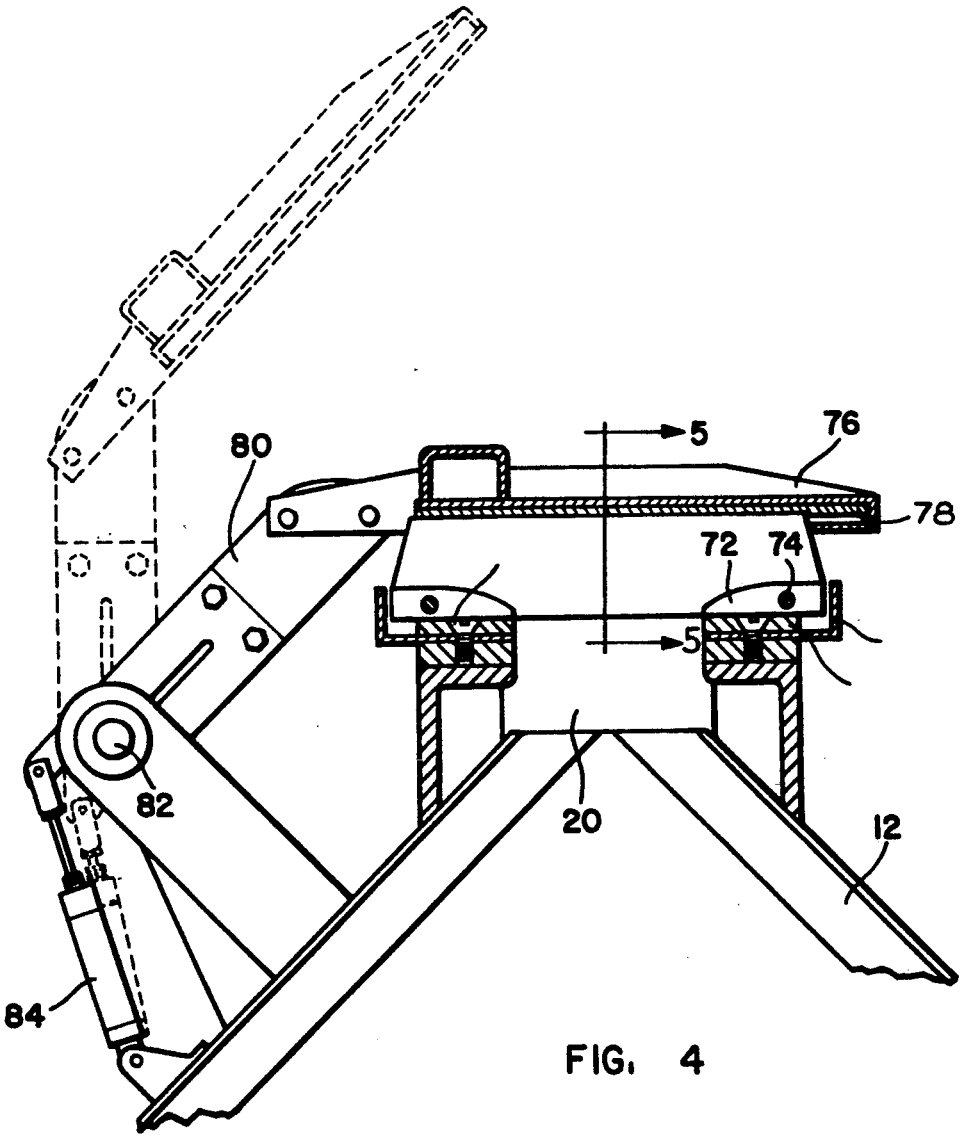
FIG. 4 is an enlarged cross-sectional view of the reed section of the yarn cleaning apparatus of FIG. 1, also taken along line 3—3 thereof.
Figure 5:
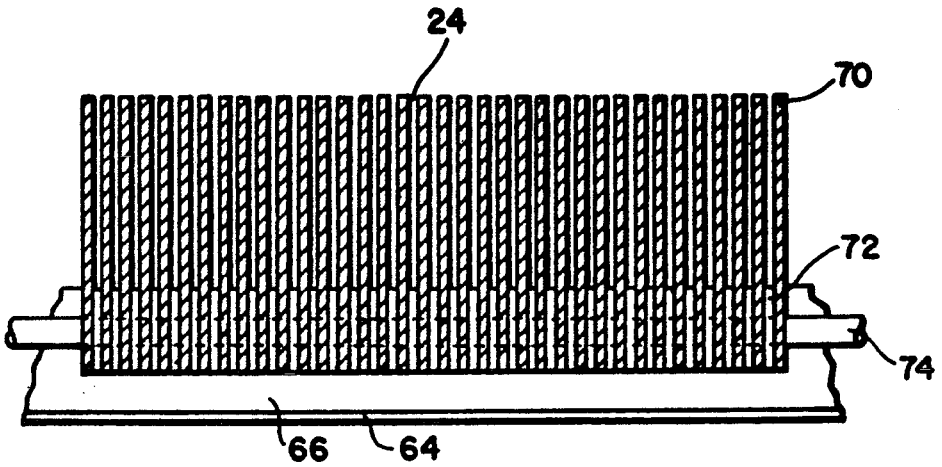
FIG. 5 is an enlarged cross-sectional view of the reed assembly of the yarn cleaning apparatus of FIG. 1 taken along line 5—5 of FIG. 4.

The construction of the reed assembly 22 is best seen in FIGS. 4 and 5. The reed assembly 22 includes a base assembly formed by a pair of elongate L-shaped angle members 64 and a pair of correspondingly elongate rectangular metal bars 66 affixed by a plurality of countersunk screws 68 in opposed spaced mirror-image relation to one another at the upper end of the framework of the housing 12 along opposite sides of the opening 20. Preferably, the angle members 64 are formed with laterally elongated slots through which the screws 68 are received to permit the angle members 64 to be adjustably positioned toward and away from another. A plurality of planar plate-like fins 70 are assembled in spaced relation to one another by intervening spacer elements 72, one pair of which is interposed between each adjacent pair of fins 70, and by a pair of elongate rods 74 extending through aligned openings in the fins 70 and the spacer elements 72 at opposite lower sides of the fins 70. The resultant spacings between the fins 70 define the reed slots 24. The opposite ends of the through rods 74 are provided with threaded necks or enlarged heads (not shown) to fixedly secure together the assembly of fins 70, spacer element 72, and through rods 74. The fins 70 and spacer elements 72 are sufficient in number and the through rods 74 are sufficient in length to form the assembly thereof of a length corresponding to the length of the upper opening 20 in the housing 12, the assembly of the fins 70, spacer elements 72, and through rods 74 resting on the support bars 66 between the opposed angle members 64 in covering relation to the upper housing opening 20. In this manner, each reed slot 24 is in open communication with the interior area 14 of the housing 12 through the lateral spacings between the spacer elements 72 and through the upper opening 20 in the housing 12.

The cover assembly 30 includes an elongate cover plate 76 of inverted U-shape within the underside of which is contained a resilient foam pad 78, the cover plate 76 and pad 78 being of elongate and transverse dimensions corresponding substantially to the reed assembly 22. The cover plate 76 is affixed to a pair of support arms 80 pivotably mounted on a longitudinally extending shaft 82 for pivotal movement of the cover plate and pad assembly 76,78 between an operative position in covering relation to the reed assembly 22 with the pad 78 in sealing contact with the upward edges of the fins 70, shown in full lines in FIG. 4, and an inoperative position spaced upwardly and laterally from the reed assembly 22 shown in broken lines in FIG. 4. A pair of pneumatically operated piston-and-cylinder assemblies 84, or other suitable linear actuators, are affixed between the exterior of the housing 12 and the support arms 80 for selectively actuating pivotal movement of the cover plate and pad assembly 76,78 between its operative and inoperative positions.

Figure 6:
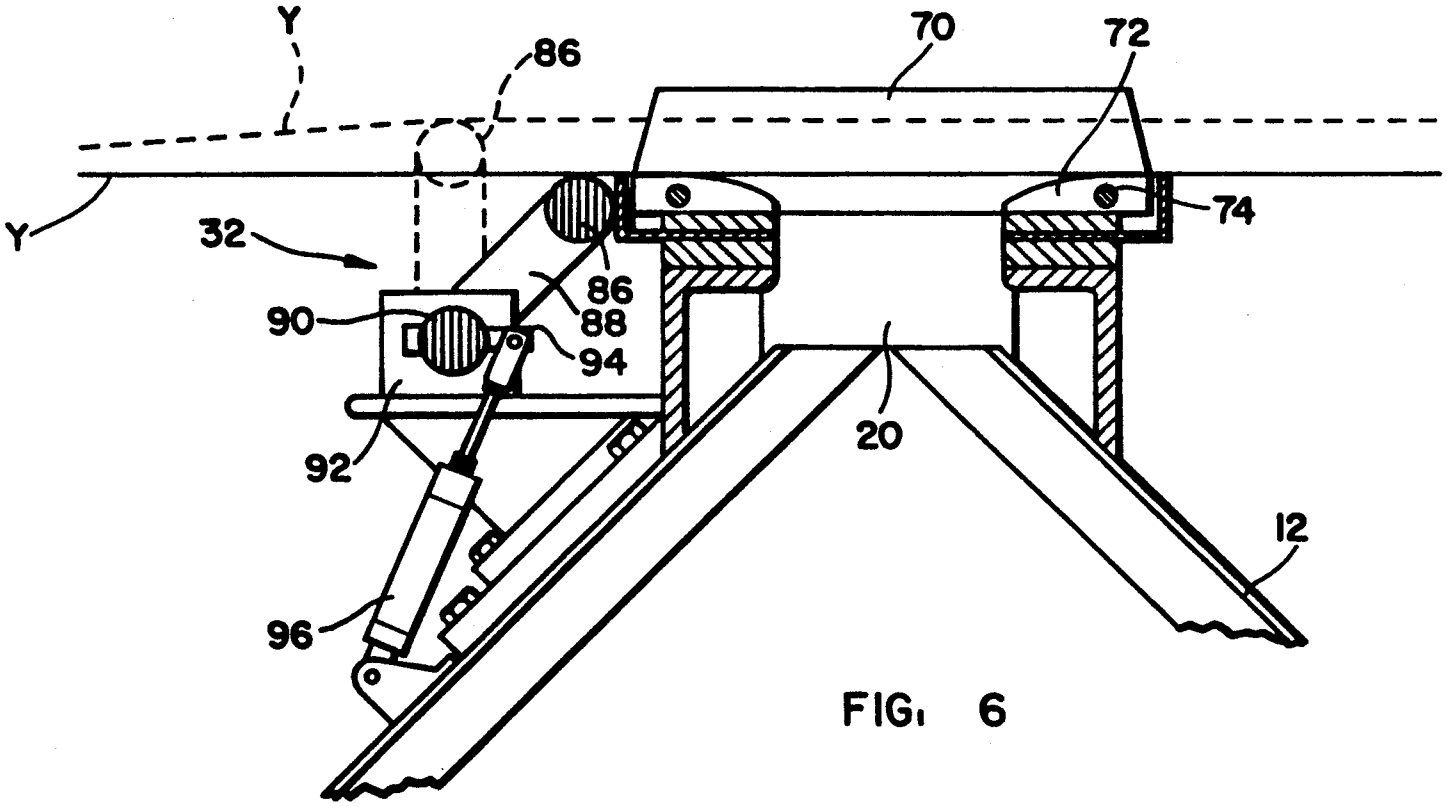
FIG. 6 is a detailed side elevational view of an auxiliary mechanism of the yarn cleaning apparatus of FIG. 1 for reciprocating yarns vertically within the reed portion of the yarn cleaning apparatus.

As best seen in FIG. 6, the yarn manipulating assembly 32 includes a smoothly surfaced elongate cylindrical rod 86 of a longitudinal dimension corresponding to the reed assembly 22, mounted between the extending ends of a pair of support arms 88, the opposite ends of which are affixed to a pivot shaft 90 rotatably supported on the exterior of the housing 12 by support bearings 92. An actuating arm 94 projects radially outwardly from the shaft 90 at substantially midway along its length and is affixed to the extending piston of a pneumatically-operated piston-and-cylinder assembly 96 or other suitable linear actuator mounted adjacently on the exterior of the housing 12 for selectively actuating reciprocal rotation of the shaft 90 and, in turn, reciprocal pivoting of the support arms 88 and the cylindrical bar 86.

The operation of the present invention may thus be understood. Typically, the yarn cleaning apparatus 10 will be situated in a textile warping system immediately in advance of the warper (not shown) with each of the individual warp yarns Y traveling in side-by-side relation in the form of the warp yarn sheet W being directed to travel through an individual respective one of the reed slots 24. In initial thread-up of the warp yarns Y, the cover assembly 30 will be pivoted upwardly in its inoperative disposition to facilitate placement of the individual yarns Y in their respective reed slots 24. During an ongoing warping operation, the cover assembly 30 remains in its downwardly pivoted operating disposition in sealed covering relation to the fins 70 of the reed assembly 22, except when a yarn breakage or similar event necessitates stoppage of the warping line for piecing and rethreading of the broken yarn through its respective reed slot 24.

The blower 26 is actuated during the course of an ongoing warping operation to apply a suction force through each individual reed slot 24 to remove surface lint, dust, and other debris from the warp yarns Y as they travel through the reed assembly 22 en route to the warper. In this manner, the yarns Y are effectively cleaned of such debris immediately in advance of winding of the yarns Y onto a warp beam in the warper, thereby minimizing the potential production of debris-related defects such as slubs and the like in fabrics subsequently produced from the warp yarns. Substantially all such lint, dust, and debris is, in turn, separated from the blower-generated air stream by the filter media 62 of the filter assembly 28. When a significant quantity of filtered debris has accumulated on the filter media 62, the filter drawer 54 may be manually withdrawn from the housing 12, preferably only during stoppages of the warping system, for manual removal and discarding of the debris from the filter media 62.

The yarn manipulating assembly 32 is periodically actuated at sufficient intervals during the course of a warping operation to reciprocate the warp sheet W of yarns Y upwardly and downwardly within their respective reed slots 24, which serves to prevent localized wearing of the fins 70 and spacer elements 72 of the reed assembly 22 and also effectively produces a wiping action of sorts by the warp yarns Y on the surfaces of the fins 70 and spacer elements 72 of the reed assembly 22 to prevent lint and debris accumulating thereon.

The cover assembly 30 serves several purposes during warping operation. First, the cover assembly 30 largely prevents airborne lint and debris from being drawn into and collecting on the reed assembly 22 by the suction action of the blower 26. At the same time, the cover assembly 30 prevents the blower 26 from imposing additional tension on the yarns Y as they travel through the reed assembly 22. Specifically, by closing the upward extent of each reed slot 24, the cover assembly 30 prevents ambient air from entering the reed assembly 22 except at the more limited forward and rearward yarn entrance and exit openings into the slots 24. In this manner, ambient air is caused to flow into each reed slot 24 at one side thereof in a direction substantially the same as the direction of yarn travel and at the other side thereof in a direction substantially opposite to the direction of yarn travel, thereby producing substantially equal counteracting suction forces on each traveling yarn Y so that, in effect, the suction forces do not increase tension in the yarns Y. The significance of this effect increases as the warping speed increases. For example, current high speed warpers may operate at yarn traveling speeds up to 1,000 yards per minute. Necessarily, the suction air flow generated by the blower 26 should move at a substantially greater speed or velocity in order to effectively remove surface lint and debris from the traveling yarns. It is contemplated that desirable air flow velocities may be on the order of up to twenty times the yarn traveling speed. At such comparatively higher air flow rates, it is important that the suction air flow not affect yarn tension.

Figure 7:
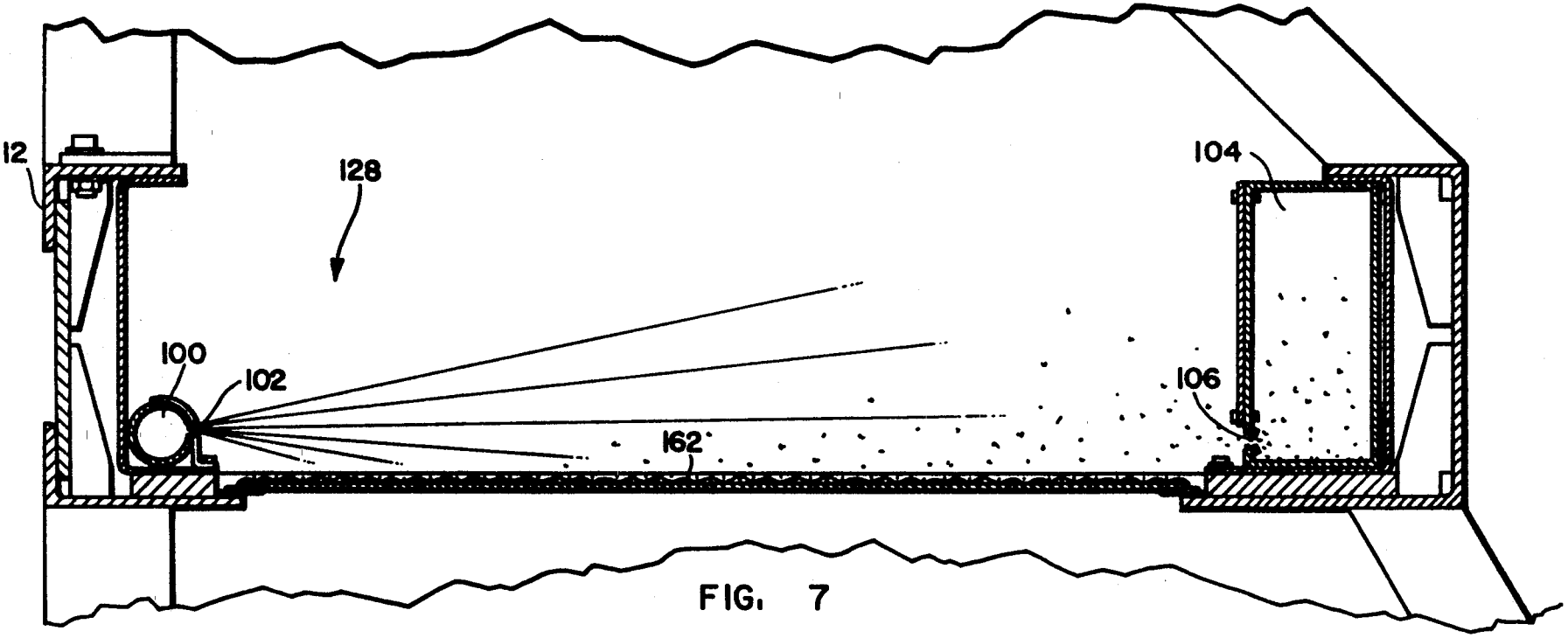
FIG. 7 is a widthwise vertical cross-sectional view of an alternative embodiment of filter section for use in the yarn cleaning apparatus of FIG. 1.
Figure 8:
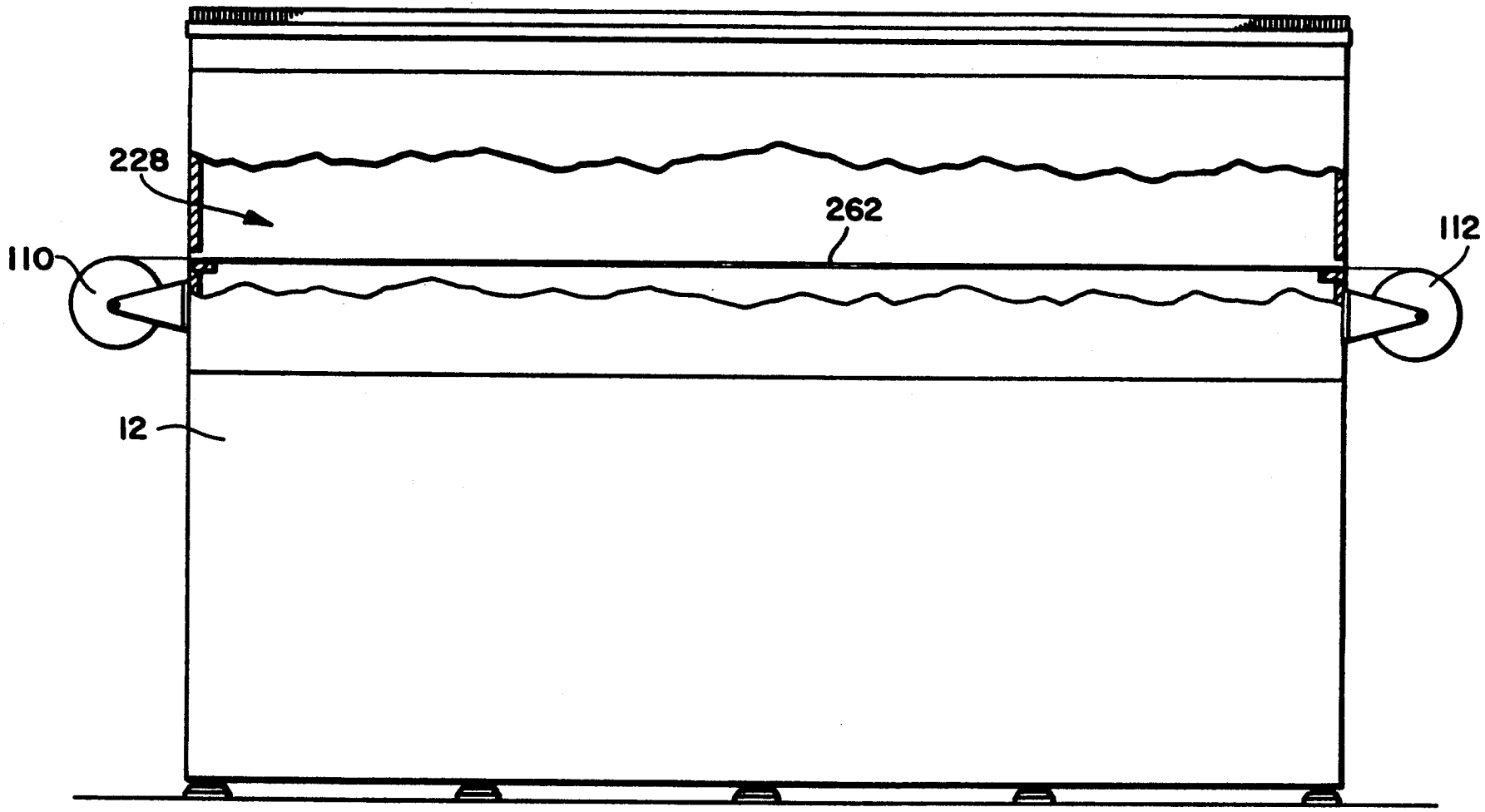
FIG. 8 is a lengthwise vertical cross-sectional view of another alternative embodiment of filter section for the yarn cleaning apparatus of FIG. 1.

As previously mentioned, the filter assembly 28 may be of various other constructions than the slidable filter drawer 54 of FIGS. 1-3. By way of example, two alternative filter assemblies are illustrated in FIGS. 7 and 8. In the filter assembly embodiment of FIG. 7, the filter drawer 54 of FIGS. 1-3 is eliminated and, instead, a filter screen or other suitable filter media 162 is immovably affixed horizontally side-to-side and end-to-end within the intermediate section of the housing 12. A tubular pneumatic nozzle 100 is affixed lengthwise to the housing 12 immediately adjacent one lengthwise edge of the filter media 162 at the intake or "dirty" side thereof, the nozzle 100 having a plurality of discharge openings 102 spaced along its length directed laterally across the lint accumulating surface of the filter media 116. The nozzle 100 is operatively connected to a source of pressurized air, such as commonly available from a central location in textile mills, through a suitable associated valve or the like (not shown) for selectively admitting pressurized air into the nozzle 100 for discharge laterally across the width of the filter media 162 along substantially the full length thereof. A vacuum chamber 104 is disposed alongside the opposite lengthwise edge of the filter media 162 and is operatively communicated through ductwork or the like (not shown) with a suitable source of suction, such as a centralized Abington-type centralized vacuum system commonly available in most textile mills. The vacuum chamber 104 is formed with a longitudinally-extending slot 106 immediately adjacent the debris accumulating face of the filter media 162 in substantially direct facing relation to the nozzle 100.

In the operation of the filter assembly 128 of FIG. 7, lint, dust, and like debris accumulates progressively on the upper face of the filter media 162 in the same manner as above-described with respect to the filter media 62 of the filter drawer 54 in FIGS. 1-3. At periodic intervals over the course of a warping operation, preferably, for example, during system stoppages, pressurized air is admitted into the nozzle 100 and, in turn, discharged through the nozzle openings 102 to pneumatically separate accumulated lint and debris from the adjacent face of the filter media 162 and blow the separated debris laterally across the filter media 162 toward the slot 106 in the vacuum chamber 104. At the same time, a vacuum is applied to the interior of the vacuum chamber 104, causing separated lint and debris blown across the filter media 162 by the nozzle 100 to be sucked into the vacuum chamber 104 and, in turn, to be carried away through the associated ductwork to a remote collection location.

FIG. 8 schematically illustrates an alternative filter assembly 228 wherein the filter media 262 is in the form of an elongate length wound on a supply roll 110 rotatably supported exteriorly of the housing 12 at one end thereof from which the media 262 passes sealably through the housing 12 into the interior area 14, longitudinally therethrough, and then sealably through the opposite end of the housing 12 for rewinding onto a take-up roll rotatably mounted exteriorly to the housing 12 at its opposite end. The lateral dimension of the filter media 262 corresponds to the interior width of the housing 12 so that the portion of the filter media 262 within the housing 12 at any given time occupies its full lateral and longitudinal extents.

During warping operation, the filter media 262 is caused to travel progressively from the supply roll 110 to the take-up roll 112, e.g., by driving the take-up roll 112, at a sufficiently slow rate of travel for accumulation of lint and debris in the form of a continuous blanket on the traveling filter media 262. In this manner, the separated lint and debris is collected in a form which may be used in the nature of a nonwoven fibrous blanket for varying possible uses. It is contemplated that a needling or calendaring unit may be provided on the housing 12 immediately in advance of the take-up roll 112 to further process the lint blanket for further usage.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. Apparatus for cleaning a traveling textile yarn comprising yarn guide means defining entrance and exit openings and a substantially enclosed yarn guide passageway extending between said entrance and exit openings for yarn travel through said passageway and means for applying a suction force to said passageway transversely with respect to the path of yarn travel for removing lint and other debris from the traveling yarn, said yarn guide means comprises base means defining said passageway, said entrance and exit openings and a longitudinal slot opening into said passageway along and transversely with respect to its length, and means for selectively opening and closing said slot.

2. Apparatus for cleaning a traveling yarn according to claim 1 and characterized further in that said suction applying means is arranged to draw ambient air into said passageway through each of said entrance and exit openings with generally equal suction force to minimize imposition of additional tension on the traveling yarn.

3. Apparatus for cleaning a traveling yarn according to claim 1 and characterized further in that said means for opening and closing said slot comprises a movable cover.

4. Apparatus for cleaning a traveling yarn according to claim 1 and characterized further by means for collecting lint and debris removed by said suction applying means.

5. Apparatus for cleaning a traveling yarn according to claim 4 and characterized further in that said collecting means comprises a filter.

6. Apparatus for cleaning a traveling yarn according to claim 5 and characterized further in that said filter comprises an elongate filter substrate longitudinally movable in the direction of its lengthwise dimension for collecting lint and debris thereon in the form of an elongate blanket.

7. Apparatus for cleaning a traveling yarn according to claim 1 and characterized further by means for moving the yarn within said guide means transversely of the direction of yarn travel.

8. Apparatus for cleaning a traveling yarn according to claim 7 and characterized further in that said yarn moving means comprises means for reciprocating the yarn in wiping contact with a facing surface of said guide means.

9. Apparatus for cleaning a plurality of traveling textile yarns comprising a reed for guiding a plurality of traveling textile yarns in segregated side-by-side relation, said reed including means defining a plurality of substantially enclosed yarn guide passageways arranged in generally parallel side-by-side relation, each yarn guide passageway having an entrance opening and an exit opening, for travel of a respective yarn through each said passageway, and means for applying a suction force to each said passageway transversely with respect to the path of yarn travel for removing lint and other debris from each yarn, said reed comprising base means defining each said passageway, each of said entrance and exit openings and a respective longitudinal slot opening into each said passageway along and transversely with respect to its length, and means for selectively opening and closing said slots.

10. Apparatus for cleaning a plurality of traveling textile yarns according to claim 9 and characterized further in that said suction applying means is arranged to draw ambient air into each said passageway through each of its said entrance and exit openings with generally equal suction force to minimize imposition of additional tension on the traveling yarns.

11. Apparatus for cleaning a plurality of traveling textile yarns according to claim 9 and characterized further in that said means for opening and closing said slots comprises a cover movable into and out of covering relation to said slots of said base means.

12. Apparatus for cleaning a plurality of traveling textile yarns according to claim 9 and characterized further by means for collecting lint and debris removed by said suction applying means.

13. Apparatus for cleaning a plurality of traveling textile yarns according to claim 12 and characterized further in that said collecting means comprises a filter.

14. Apparatus for cleaning a plurality of traveling textile yarns according to claim 13 and characterized further in that said filter comprises an elongate filter substrate longitudinally movable in the direction of its lengthwise dimension for collecting lint and debris thereon in the form of an elongate blanket.

15. Apparatus for cleaning a plurality of traveling textile yarns according to claim 9 and characterized further by means for moving each yarn within its respective said guide passageway transversely of the direction of yarn travel.

16. Apparatus for cleaning a plurality of traveling textile yarns according to claim 15 and characterized further in that said yarn moving means comprises means for reciprocating each yarn in wiping contact with a facing surface of said guide means.

17. Apparatus for cleaning a traveling textile yarn comprising yarn guide means defining entrance and exit openings and a substantially enclosed yarn guide passageway extending between said entrance and exit openings for yarn travel through said passageway, means for applying a suction force to said passageway transversely with respect to the path of yarn travel for removing lint and other debris from the traveling yarn, and means for collecting lint and debris removed by said suction applying means, said collecting means comprising a filter having an elongate filter substrate longitudinally movable in the direction of its lengthwise dimension for collecting lint and debris thereon in the form of an elongate blanket.

18. Apparatus for cleaning a traveling textile yarn comprising yarn guide means defining entrance and exit openings and a substantially enclosed yarn guide passageway extending between said entrance and exit openings for yarn travel through said passageway, means for applying a suction force to said passageway transversely with respect to the path of yarn travel for removing lint and other debris from the traveling yarn, and means for moving the yarn within said guide means transversely of the direction of yarn travel.

19. Apparatus for cleaning a traveling yarn according to claim 18 and characterized further in that said yarn moving means comprises means for reciprocating the yarn in wiping contact with a facing surface of said guide means.

20. Apparatus for cleaning a plurality of traveling textile yarns comprising a reed for guiding a plurality of traveling textile yarns in segregated side-by-side relation, said reed including means defining a plurality of substantially enclosed yarn guide passageways arranged in generally parallel side-by-side relation, each yarn guide passageway having an entrance opening and an exit opening, for travel of a respective yarn through each said passageway, means for applying a suction force to each said passageway transversely with respect to the path of yarn travel for removing lint and other debris from each yarn, and means for collecting lint and debris removed by said suction applying means, said collecting means comprising a filter having an elongate filter substrate longitudinally movable in the direction of its lengthwise dimension for collecting lint and debris thereon in the form of an elongate blanket.

21. Apparatus for cleaning a plurality of traveling textile yarns comprising a reed for guiding a plurality of traveling textile yarns in segregated side-by-side relation, said reed including means defining a plurality of substantially enclosed yarn guide passageways arranged in generally parallel side-by-side relation, each yarn guide passageway having an entrance opening and an exit opening, for travel of a respective yarn through each said passageway, means for applying a suction force to each said passageway transversely with respect to the path of yarn travel for removing lint and other debris from each yarn, and means for moving each yarn within its respective said guide passageway transversely of the direction of yarn travel.

22. Apparatus for cleaning a plurality of traveling textile yarns according to claim 21 and characterized further in that said yarn moving means comprises means for reciprocating each yarn in wiping contact with a facing surface of said guide means.

* * * * *